United States Patent [19]

Steinhoff

[11] Patent Number: 4,937,946

[45] Date of Patent: Jul. 3, 1990

[54] MASONRY LINE STRETCHER

[76] Inventor: Alvin C. Steinhoff, 23721 Singapore St., Mission Viejo, Calif. 92691

[21] Appl. No.: 440,812

[22] Filed: Nov. 24, 1989

[51] Int. Cl.[5] ..... G01C 15/10

[52] U.S. Cl. ..... 33/410

[58] Field of Search ..... 33/407–410, 33/413

[56] References Cited

U.S. PATENT DOCUMENTS

| | | | |
|---|---|---|---|
| 391,496 | 10/1888 | Vogelsong . | |
| 1,234,282 | 7/1917 | Butler . | |
| 2,215,663 | 9/1940 | Frisk . | |
| 2,919,489* | 1/1960 | Espinosa . | |
| 3,156,982 | 11/1964 | Wahlin | 33/408 |
| 3,626,434 | 12/1971 | Miller | 33/408 |
| 3,698,089 | 10/1972 | Huston . | |
| 4,599,804 | 7/1986 | Amos | 33/410 X |

OTHER PUBLICATIONS

Goldblatt: "Adjustable Line Stretchers" p. 38.

*Primary Examiner*—Harry N. Haroian

*Attorney, Agent, or Firm*—Gordon K. Anderson

[57] ABSTRACT

A masonry line stretching apparatus which has a body (20) of cast aluminum material with an integral upright finger (24) and lower jaw (32). A slideable jaw (40) is positioned on the body and is free to be adjustably moved relative to the lower jaw. A stop (52) retains the slideable jaw and the device is used in pairs with the jaws being adjusted into a gripping position on a building block (38) in the form of a brick (44) or concrete block (48). A masons line (36) is strung between two of the apparatus positioned adjacent to corner building blocks allowing the mason to maintain a straight row or face during the construction process. The device may be used with the body disposed on top of the block or opposite with the body cantilevered therefrom. The jaws grip either the entire block, in the case of a brick, or from the opening (46) to the edge, in the case of a concrete or cinder block (48).

8 Claims, 2 Drawing Sheets

24
26
28
28
30
40
20
34
22
a
32
52
a
50

5
6
24
26
30
40
52
22
20
28
28
50
4
34
4

5
6
32
52
20
22

22
24
26
40
20
42
22
22
50

40
24
26
30
52
28
28
20
22
42
34

50
32

MASONRY LINE STRETCHER

TECHNICAL FIELD

The present invention relates to alignment devices in general, and more specifically to adjustable devices to hold masonry guide lines taut for aligning building blocks, such as cinder block, concrete block, and bricks when being laid by a mason.

BACKGROUND ART

Previously, many types and styles of line stretchers have been used in endeavoring to provide an effective means to stretch a line or alignment cord from the corners of building blocks during the building process. From antiquity, masons have used lines or cords to establish a straight row of building blocks, however, progress has changed only the sizes and styles of blocks with the basic requirement still remaining unaffected. Prior art has utilized devices, such as elaborate line stretching gauges with vertical standards to simple wedge shaped corner grasping holders, with others tightening the line with threaded screws and wing nuts or winding blocks. Others employed ratchet wheel drums for tightening the lines and sliding plates, and the like, which function properly but have a tendency to be complex and cumbersome.

A search of the prior art did not disclose any patents that read directly on the claims of the instant invention, however, the following U. S. patents were considered related:

| U.S. Pat. No. | Inventor | Filing Date |
|---|---|---|
| 3,698,089 | Huston | Oct. 17, 1972 |
| 2,919,489 | Espinosa | Jan. 05, 1960 |
| 2,215,663 | Frisk | Sep. 24, 1940 |
| 1,234,282 | Butler | Jul. 24, 1917 |
| 391,496 | Vogelsong | Oct. 23, 1888 |

Huston teaches a slotted clamp having a pair of screws, with washers and wing nuts, positioned in the slot. The screws grip each side of a building block and are adjusted by tightening against each edge. The guide line is held in place between a flat and dished washer and the cord is secured at the opposite end by winding around the screw between the washers.

Espinosa clamps the holder to a block with a movable plate member on one side and a fixed plate on the other. The adjustment is made by sliding a movable section with longitudinally extending ribs and locking it into place with a thumb screw. A ratcheted wheel drum retains the line and is held taut by rotating the handle of the drum until tight and utilizing the ratchet to provide securement.

Frisk grips the block with offset grapple lugs on one end and adjustable anchoring lugs on the other. The adjustment, again, employs the use of a wing nut with a stud that may be passed through either of two longitudinally spaced holes. The anchoring lug is notched, allowing the line to pass unobstructed. A take-up block allows the line to be secured and wound thereupon. Final anchoring of the bars is accomplished by the tension on the line rocking the bars on the engaging end producing the wall gripping action.

Butler employs a wedge driven into a wall attached to a standard. A bracket is slideably mounted to the standard and held in adjustment by a set screw. A series of notches are located in a gauge plate and the line is passed through the proper notch. The gauge plate and line are moved upward as successive courses are laid.

Vogelsong, over a century ago, utilized a bladelike pin sharpened on one end with a shoulder projecting at right angles forming an enlargement. A recess is formed into the enlargement allowing the device to be used on corners. A hole is provided near the shoulder through which a line is passed with a V-groove gripping the line.

Some commercially available line stretchers today are either sized to fit a particular block, or are adjustable by using a wing nut and bolt with mating holes. The line is wrapped around protruding appendages and the tension of the line cocks each tensioner toward each other locking them into place.

DISCLOSURE OF THE INVENTION

As much of the prior art has been directed to grasping the building block and holding the cord by rather complex means and adjustments that require dissembly, or at least threaded fasteners that hold parts together and attach the string, the need has existed for an improvement to simplify not only the stretcher itself, but the procedure. Furthermore, since building material has only subtly changed in variations of holes or cavities and popularity in sizes, the invention is directed to accomplish both the simplicity and versatility to fit all commonly used sizes and configurations in a simple, yet, straightforward manner.

It is, therefore, a primary object of the invention for the masonry line stretcher to fit any building block or brick, including slump stone, irregular face, split face block, normandie type, roman style structural glazed tile, glass block, acid brick, acid tile, fire brick, solid masonry, cellular design block, and obviously common red brick and concrete or cement block. The size of the device must be large enough to fit the above types and styles and, yet, be small enough to be easily carried in a pocket and particularly in the masons tool box. This is accomplished by bricks or openings in the blocks to provide the gripping surface, therefore, the overall length may be less than the width of a common concrete block. The simplicity of form makes the use intuitively obvious to the mason and, therefore, complex operating instructions are unnecessary.

An important object of the invention is the flexibility of the method of attachment, as the adjustment is made in the width of the grip by simply moving the sliding jaw to the proper location with ones thumb or other hand. This adjustment allows the device to be used with the body either on the inside or outside of the wall being built according to convenience. FIG. 9 illustrates this object with the advantage being obvious to the user as some applications have obstructions limiting the gripping surface available and the reversibility allows this problem to be easily overcome. The fixed lower jaw and slideable adjustment jaw are configured alike, except opposite allowing use on either side.

Another object of the invention is the ease of installation, as the device is simply placed on the block in the appropriate location and the slideable jaw is pushed into contact with the block, either spanning the entire width, such as with a conventional brick, or from the hole or opening in a block to the front face. The line is then wrapped around the upright finger and the upper portion of the slideable jaw pulling the jaw into contact with the block and simultaneously twisting the device, providing tension on the combined gripping surfaces.

Most of the prior art simply relies upon the twisting position as variations in width beyond the adjustment range are taken up by the torsional angle created by cord tension. Since no wing nuts or screws are removed or thumbscrews tightened, the invention is completely adjustable by a simple movement of the sliding jaw.

Still another object of the invention allows conventional line or cord to be used and be exactly aligned against the face of the building block. This positioning is accomplished by a specific acute angle being maintained between the lower and slideable jaws and the longitudinal body and the relationship of the length of the jaws. As the line is contiguous with the face of the block on either side this exacting continuity is maintained allowing the mason to lay the blocks true and even therebetween.

A further object of the invention is directed to the material of construction which may be almost anything used for tools of this nature. Aluminum is preferred in a casting which provides a light and durable device that is easily handled without sharp edges and is not subjected to corrosion or undue oxidation.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 8:
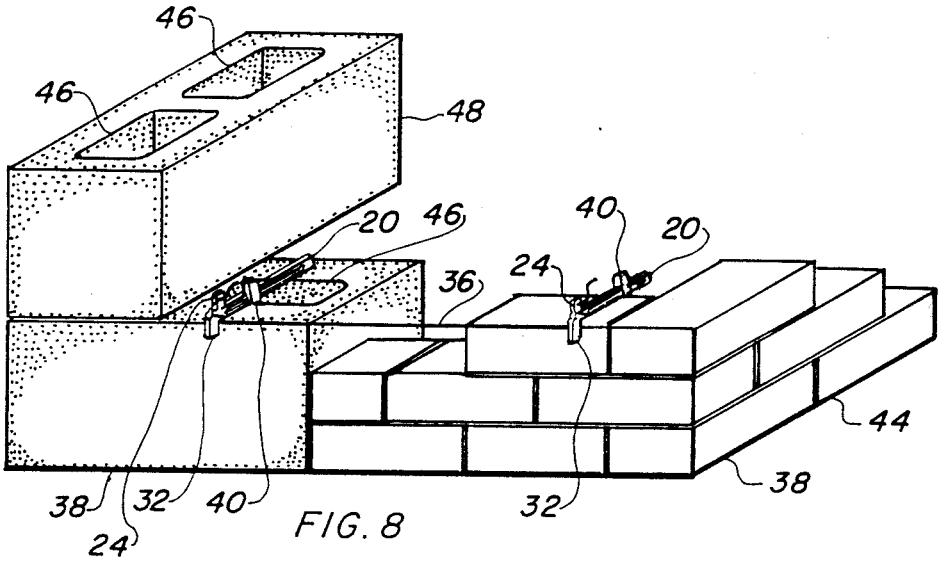
FIG. 8 is a partial isometric view of the line stretching apparatus, used in pairs, on a wall constructed using a combination of cinder blocks and bricks.
Figure 9:
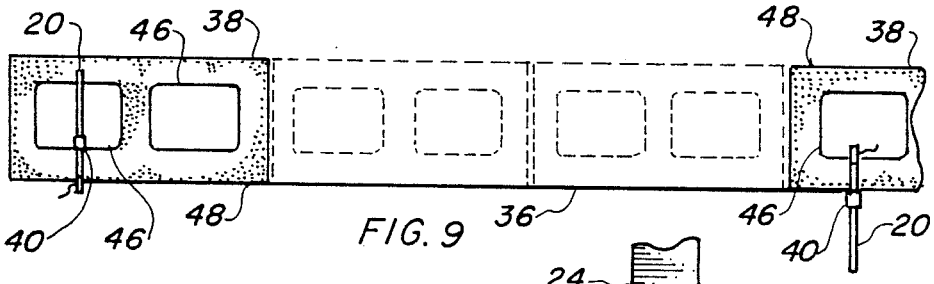
FIG. 9 is a plan view of a wall under construction with the invention mounted on both the front and rear of the outside surface and the guide line therebetween.

The best mode for carrying out the invention is presented in terms of a preferred embodiment illustrated singly for the most part, however, they are used in pairs as depicted in FIGS. 8 and 9.

Figures 1, 2, 3, 4, 5, 6, 7:
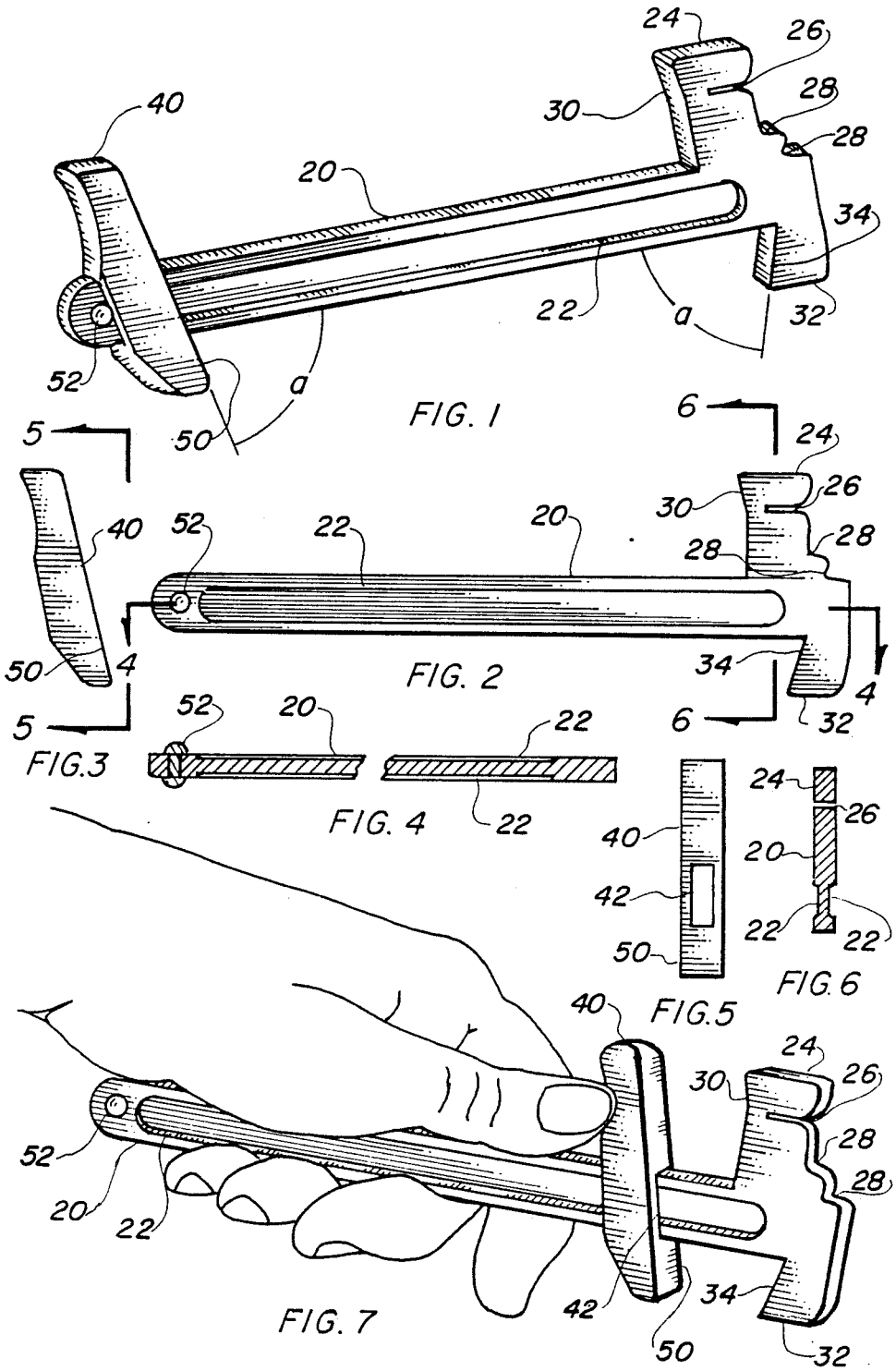
FIG. 1 is a partial isometric view of the preferred embodiment shown singly with the acute angle of the jaws designated "a".
FIG. 2 is a side elevational view of the body by itself.
FIG. 3 is a side elevational view of the slideable jaw completely removed from the invention for clarity.
FIG. 4 is a cross-sectional view taken along lines 4—4 of FIG. 2.
FIG. 5 is a view taken along lines 5—5 of FIG. 3.
FIG. 6 is a cross-sectional view taken along lines 6—6 of FIG. 2.
FIG. 7 is a partial isometric view of the preferred embodiment held in a masons hand with the thumb adjusting the slideable jaw.

The preferred embodiment, as shown in FIGS. 1 through 12 are comprised of a longitudinal body 20 in rectangular shape, somewhat wider than it is deep. The preferred shape is in the form of an "I" beam created by a hollow 22 on each side, as illustrated in FIGS. 4 and 6. This hollow 22 runs almost the entire length of the body 20 and lightens the structure without substantial loss in strength.

An upright finger 24 is integrally formed as part of the body 20 and contains a slit 26 for positioning and retaining a masonry line 36. The configuration of the finger 24 may be any shape, however, it has been found that a pair of concave recesses 28 in the front and a rearwardly angled face 30 on the back provide a convenient surface for wrapping a masonry line. The corners of this finger 24 are also rounded to allow easy handling.

Figure 10:
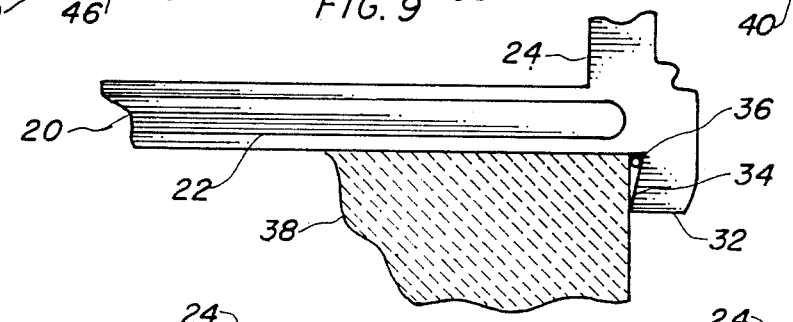
FIG. 10 is a side elevational view of the body mounted on a block with the guide line illustrated in the area formed by the angle of the lower jaw.

A lower jaw 32 is also integral with the body 20 and forms an acute angle from the inside face 34 of the jaw 32 relative to the body 20. This angle is designated "a" in FIG. 1 and is between 70 and 80 degrees with 75 degrees being found to be optimum when the length of the jaw 32 is 0.625 inches (1.59 cm) extending from the bottom edge of the body. This angle allows a line 36 to be positioned between the body 20 and the lower jaw 32, as illustrated in FIG. 10, contiguous with the front surface of the building block 38.

A slideable jaw 40, with an aperture 42 therein, is positioned on the body 20 and is free to slide back and forth allowing adjustment to mate with either the outside of a brick 44 or on a combined front surface and the opening 46 or hole in a concrete or cinder block 48. This adjustment provides versatility for the apparatus as most conventional building blocks 38 may be retained, particularly the bricks 44 or concrete and cinder blocks 48 in common use today. The jaw 40 has a lower portion 50 that forms an acute angle relative to the body 20 opposite the lower jaw 32, such that a slideable face to face relationship is formed therebetween when applied to the above mentioned building blocks 38. As previously described, this acute angle is designated "a" in FIG. 1 and is identical for both lower elements 50 and 32. This angle "a" allows the guide line 36 to be aligned with the face of the building block 38, as previously mentioned, even if the apparatus is reversed and the body 20 is on the outside of the block and the slideable jaw 40 becomes the line attaching element.

The aperture 42 in the slideable jaw 40 is formed to allow the lower portion 50 to grip the block 38 when tilted outwardly in a binding action. This clinches or grips the block 38 tightly, particularly when a line 36 is pulled taut between a pair of line stretchers and the line is looped around the upright finger 24 and upper part of the slideable jaw 40. Further, the aperture 42 in the jaw 40 is formed large enough to allow a few particles of sand or a small amount of morter to be in the gap between the elements without binding or impeding the action of the slideable jaw 40 on the body 20.

A stop 52 is attached to the body 20 near the extreme end opposite the finger 24 and lower jaw 32. This stop 52 may be in the form of a rivet, as illustrated in FIGS. 1, 2, 4 and 7, or may be a screw, roll pin, or any convenient hardware item, as long as it may be added after the slideable jaw 40 is located in place.

The material for the apparatus may be die cut steel for the body 20 and forged steel for the slideable jaw 40, or thermoplastic material for the entire structure. It is preferable, however, to fabricate the invention using cast aluminum with an aluminum rivet as the stop 52, as it is light in weight, durable, and does not require any special finish or corrosion protection.

Figure 12:
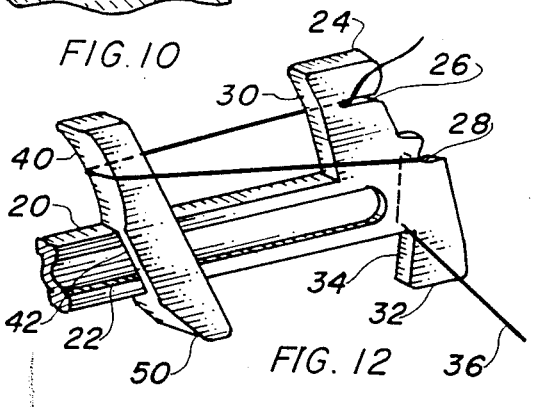
FIG. 12 is the same illustration as FIG. 11, except the body is extended inwardly relative to the block locating the line on the opposite member.

In practice, the apparatus is used in pairs with the building blocks 38 laid on each corner, as illustrated in FIGS. 8 and 9. The outer block, or the next longitudinal block, is spanned by one of the devices, either across the entire width, as illustrated in FIG. 8 in the form of a brick on the right side, or is attached to the opening in a concrete or cinder block, as depicted on the left side of the same figure. Adjustment is easily made by simply sliding the jaw 40, using the masons finger or thumb as shown in FIG. 7. The line 36 is attached to the outer end of the device, as illustrated in FIG. 8 and 12, by first placing the line 36 on the face of the building block, as depicted in FIG. 10, in the area formed by the acute angle "a". The line is then placed over the side of the upright finger 24 and into one of the recesses 28 reversing direction to the other side of the finger then spanning the gap to the upstanding portion of the slideable jaw 40. The line then passes around the jaw and back to the upright finger 24 where it is pulled into the slit 26 with the end then allowed to hang loose therefrom. The second device of the pair is connected in like manner, except tension is maintained on the line during the procedure. The tension of the line also cocks the line stretching apparatus toward each other maintaining a firm grip on the building block while jointly compressing the jaw 40.

Figure 11:
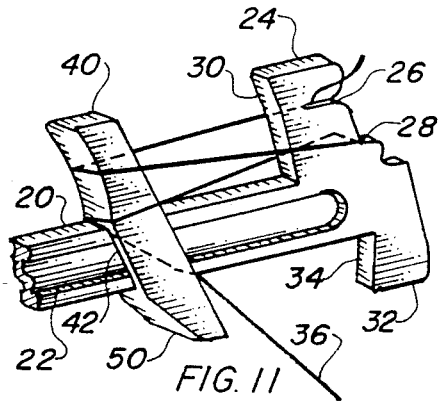
FIG. 11 is a fragmentary view of the invention with the line attached to both the slideable jaw and the upright finger as in use when mounted on a block with the body extended outwardly. The dotted lines illustrate the line behind the slideable jaw and finger.

If the device is reversed with the body 20 on the outside surface of the block 38, such as shown in the right hand device in FIG. 9, the procedure is reversed, as depicted in FIG. 11. The line 36 is again held against the block and the apparatus is set into place thereover with the line crossing over from the bottom of the body 20 to the upstanding portion of the slideable jaw 40. The line is bridged to one of the recesses 28 in the upright finger 24, then again is bridged around the slideable jaw 40 and to the slit 26 in finger 24. It may be realized that this procedure is only recommended as an infinite variation of wrapping, crossing over, and attaching methods may be made with equal ease and satisfactory results.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

What is claimed is:

1. Masonry line stretching apparatus for holding a guide line taut between building blocks comprising:

(a) a longitudinal body having a first and a second end essentially larger in width than depth;

(b) an upright finger integrally formed on an upper portion of the first end of said body having a slit therein for retaining and positioning a masonry line;

(c) a lower jaw integrally formed on a lower portion of the first end of said body, the jaw forming an acute angle relative to the body, for maintaining position on a building block;

(d) a slideable jaw having an aperture therein enclosingly passing along said body, further having a lower portion forming an acute angle relative to the body opposite said lower jaw such that a slideable face to face relationship is formed therebetween when straddling a building block, the angles of said jaws allowing a guide line to be precisely aligned on the face of a building block when said line stretching apparatus are used in pairs with the line retained at the apex of the angle and stretching tightly therebetween at right angles to each body with the line wrapped around the finger and upper portion of the slideable jaw anchoring within the slit of each finger; and, (e) a stop disposed at the second end and on an outside surface of said body such that the slideable jaw is retained when positioned onto the body.

2. The masonry line stretching apparatus as recited in claim 1 wherein said longitudinal body is essentially formed as a beam having a hollow on each side in the central portion thereof.

3. The masonry line stretching apparatus as recited in claim 1 wherein said acute angle of both fingers is between 70 and 80 degrees.

4. Masonry line stretching apparatus for holding a guide line taut between building blocks comprising:

(a) a longitudinal body having a first and a second end essentially larger in width than depth;

(b) an upright finger integrally formed on an upper portion of the first end of said body having a slit therein for retaining a slit therein for retaining and positioning a masonry line;

(c) a lower jaw integrally formed on a lower portion of the first end of said body, the jaw forming an acute angle relative to the body, for maintaining position on a building block;

(d) a slideable jaw having an aperture therein enclosingly passing along said body, the aperture in said slideable jaw in formed such that when said slidable jaw is tilted outwardly as when gripping a building block, i.e. a cinder block or brick, a binding action is defined with the body embracingly clinched, particularly so when a guide line places side thrust on the apparatus, also said aperture large enough to allow a few particles of sand or small portions of morter to be present in the interface without binding or impeding the sliding action therewith, said slidable jaw further having a lower portion forming an acute angle relative to the body opposite said lower jaw such that a slideable face to face relationship is formed therebetween when straddling a building block, the angles of said jaws allowing a guide line to be precisely aligned on the face of a building block when said line stretching apparatus are used in pairs with the line retained at the apex of the angle and stretching tightly therebetween at right angles to each body with the line wrapped around the finger and upper portion of the slideable jaw anchoring within the slit of each finger; and, (e) a stop disposed at the second end and on an outside surface of said body such that the slideable jaw is retained when positioned onto the body.

5. The masonry line stretching apparatus as recited in claim 1 wherein said stop further comprises a rivet.

6. The masonry line stretching apparatus as recited in claim 1 further comprising cast aluminum material forming the entire structure, except said stop having a forged aluminum composition.

7. The masonry line stretching apparatus as recited in claim 1 further comprising die cut steel forming the body, finger, and lower jaw with the slideable jaw and stop forged steel.

8. The masonry line stretching apparatus as recited in claim 1 further comprising thermoplastic material forming the entire structure.

* * * * *